US005123117A

United States Patent [19]

Prendergast

[11] Patent Number: 5,123,117

[45] Date of Patent: Jun. 23, 1992

[54] COMBINATION BACKPACK AND REVERSIBLE JACKET

[76] Inventor: Gerard Prendergast, 707 West Diversey, #F, Chicago, Ill. 60614

[21] Appl. No.: 669,109

[22] Filed: Mar. 13, 1991

[51] Int. Cl.[5] ..... A41D 1/02; A41D 3/00; A41D 15/04

[52] U.S. Cl. ..... 2/108; 2/86; 2/94

[58] Field of Search ..... 2/69, 86, 89, 94, 108

[56] References Cited

U.S. PATENT DOCUMENTS

| | | | |
|---|---|---|---|
| 2,248,455 | 7/1941 | Freund | 2/94 |
| 2,304,574 | 12/1942 | Kirschenbaum | 2/94 |
| 4,389,735 | 6/1983 | McLauglin | 2/94 |
| 4,404,687 | 9/1983 | Hager | 2/94 |
| 4,475,247 | 10/1984 | Lee | 2/94 X |
| 4,475,251 | 10/1984 | Hopkins | 2/94 |
| 4,476,587 | 10/1984 | Itoi | 2/94 |
| 4,483,469 | 11/1984 | Arisland | 224/151 |
| 4,502,155 | 4/1985 | Ito | 2/115 |
| 4,563,777 | 1/1986 | Park | 2/94 X |
| 4,689,831 | 9/1987 | Greenberger et al. | 2/94 X |

*Primary Examiner*—Werner H. Schroeder
*Assistant Examiner*—Jeanette E. Chapman
*Attorney, Agent, or Firm*—Poms, Smith, Lande & Rose

[57] ABSTRACT

An improved combination backpack and reversible jacket wherein the backpack includes a flap that may either (a) roll up and secure underneath the backpack when both the backpack and the jacket are in use, (b) form a pouch on the back surface of the backpack to contain the jacket when not in use, or (c) extend up and secure around the front and side surfaces of the backpack, thereby enclosing and concealing the backpack when not in use, as well as securing the backpack against the jacket so that a person may comfortably wear the reversible jacket inside out.

15 Claims, 2 Drawing Sheets

COMBINATION BACKPACK AND REVERSIBLE JACKET

FIELD OF INVENTION

This invention relates to a combination backpack and reversible jacket, and more particularly to a combination backpack and reversible jacket wherein the backpack includes a flap that may either (a) roll up and secure underneath the backpack when both the backpack and the jacket are in use, (b) form a pouch on the back surface of the backpack to contain the jacket when not in use, or (c) extend up and partially secure around the front and side surfaces of the backpack, thereby substantially enclosing and concealing the backpack when not in use, as well as securing the backpack against the jacket so that a person may turn the reversible jacket inside out and comfortably wear the jacket.

BACKGROUND OF INVENTION

During a day of outdoor activities, such as hiking or backpacking, a hiker may encounter a rise in temperature and remove a jacket that was needed earlier in the day. In the past, hikers have simply carried the unwanted jacket, or tied the jacket around their waist. Preferably, the hikers were wearing backpacks, and could store unused jackets within the backpack. However, this was not the most efficient way to store the jacket, because the jacket typically would not fit into the previously packed backpack, or else the jacket would obstruct the other items in the backpack when the hiker later attempted to remove these items from the backpack. Therefore, a need was felt for a convenient method of storing an unwanted jacket in a backpack during hiking or other outdoor activities.

In another situation, a hiker may initially neglect or forget to pack a jacket, but later encounter inclement weather. As a result a need was also felt for a backpack with a permanently attached jacket. Attempts to satisfy these different needs resulted in at least three U.S. Patents, namely, McLaughlin, U.S. Pat. No. 4,389,735, Itoi, U.S. Pat. No. 4,502,155, and Park, U.S. Pat. No. 4,563,777. These patents all disclose backpacks which contain a pouch for separately storing a jacket that is integrally formed with the backpack.

However, none of these combination backpack and jackets are useful in a situation when the jacket is needed, but the backpack is empty and no longer needed. For example, a hiker may store a lunch in a backpack, but after lunch, the backpack is empty and useless. In this situation, the hiker may desire to wear the jacket, but does not want the burden of carrying the backpack on his shoulders. Therefore, a need exists for a combination backpack and jacket in which the backpack and shoulder straps are enclosed against the jacket preventing the need to wear the shoulder straps.

An empty backpack may tend to catch on trees limbs or other obstacles. Also, in inclement weather, the hiker may desire to protect both himself and his backpack from the elements. In these situations, the hiker wants a backpack that is enclosed against the jacket and concealed from the elements.

On extended trips, the user of a combination backpack and jacket may also wish to vary the look of his jacket. Therefore, a need also exists for a combination backpack and jacket wherein the jacket is reversible to provide two different colors or types of fabric on the exterior of the jacket. The reversible jacket should also include a means for securing the backpack within the jacket so that the hiker may comfortably wear the jacket inside out.

SUMMARY OF INVENTION

One object of the present invention is to provide an improved combination backpack and jacket wherein the jacket may be stored within a separate pouch on the backpack.

Another object of the present invention is to provide an improved combination backpack and jacket wherein the jacket is integrally formed with the backpack.

A still further object of the invention is to provide an improved combination backpack and jacket wherein the backpack and shoulder straps are concealable when the jacket is being worn.

Yet another object of this invention is to provide an improved combination backpack and jacket wherein the jacket is reversible.

These and other objects of the present invention are achieved through the use of an improved combination backpack and reversible jacket wherein the backpack includes a flap that may alternatively (a) roll up and secure underneath the backpack when both the backpack and the jacket are in use, (b) form a pouch on the back surface of the backpack to contain the jacket when not in use, or (c) extend up and around the front and side surfaces of the backpack and thereby enclosing and concealing the backpack when not in use, as well as securing the backpack against the jacket so that a person may comfortably wear the reversible jacket inside out.

These and other objects of the present invention will now become apparent from a review of the drawings and the following description of the preferred embodiments.

DETAILED DESCRIPTION

Figure 1:
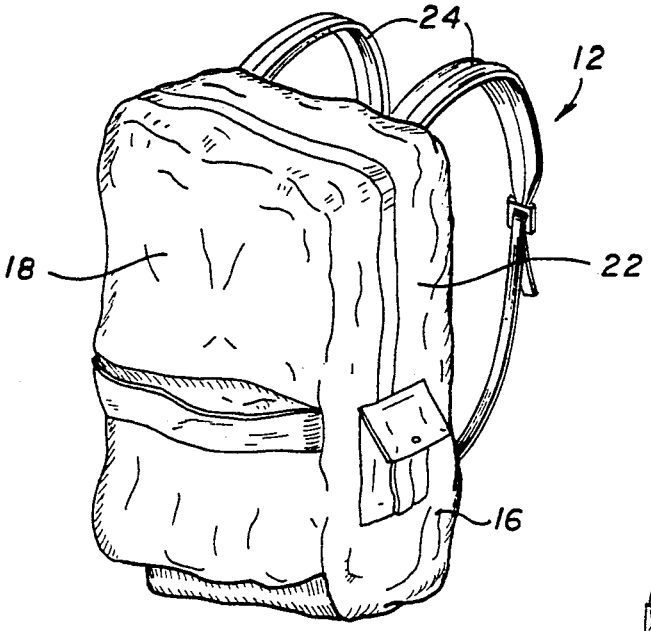
FIG. 1 is a front perspective view of the combination backpack and reversible jacket of the present invention with the jacket stored within the backpack.
Figure 2:
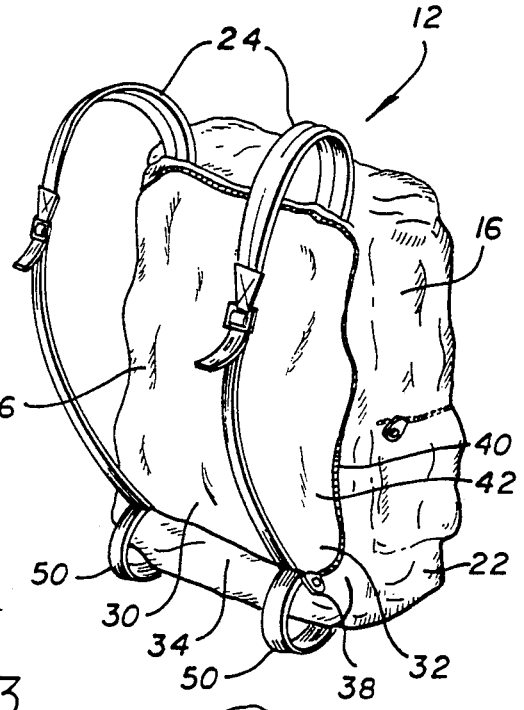
FIG. 2 is a rear perspective view of the present invention with the jacket stored within the backpack.

Referring now to FIGS. 1 and 2, a combination backpack and jacket 12 is shown with a jacket 14 stored inside a backpack 16. The backpack 16 comprises a front surface 18, a back surface 20, a side surface 22, and two shoulder straps 24. The back surface 20 has an upper end 26 and a lower end 28. The shoulder straps 24 are attached to the back surface 20 at both the upper end 26 and the lower end 28. The shoulder straps 24 are in a spaced apart relationship in order for a person to comfortably wear the straps 24 around his shoulders.

The area of the back surface 20 between the shoulder straps 24 is defined as a central portion 30.

The backpack 16 further includes a flap 32 with a secured edge portion 34 along the lower edge of the flap 32. The secured edge portion 34 is attached to the central portion 30 of the lower end 28 of the back surface 20.

Figure 3:
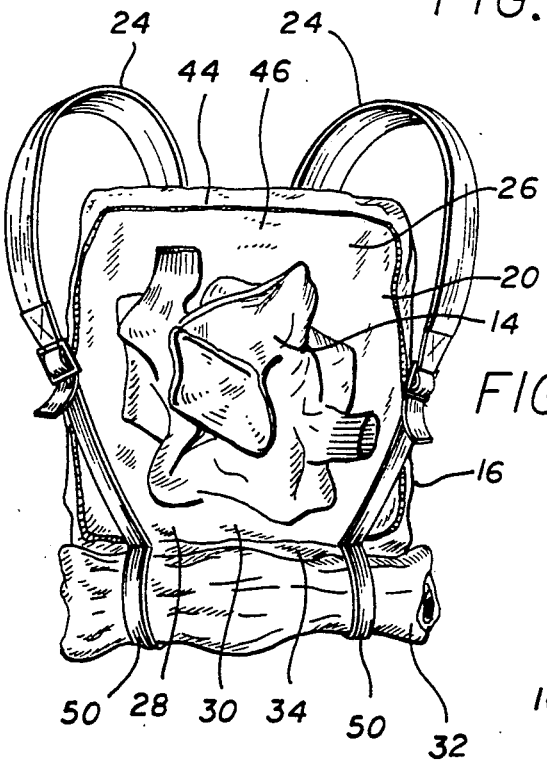
FIG. 3 is a rear view of the invention with the jacket folded in position for the flap to form a pouch around the jacket.

As shown in FIGS. 2 and 3, the backpack 16 also includes means for temporarily securing the flap 32 to the back surface 20 of the backpack 16 in order to form a pouch 36 for storing the jacket 14. In the preferred embodiment the securing means is a zipper 38. A first row of teeth 40 of the zipper 38 is sewn to a remaining periphery portion 42 of the flap 32 surrounding the secured edge portion 34. A mating row of teeth 44 is sewn in a matching configuration 46 along a periphery 48 of the back surface 20 of the backpack 16. Therefore, to store the jacket 14, the jacket 14 is folded onto the back surface 20, as shown in FIG. 3, the flap 32 is pulled upward to extend over the folded jacket 14, and the zipper 38 is zipped shut to form the pouch 36 and enclose the jacket 14. The backpack 16 with the jacket 14 stored in the pouch 36 is shown in FIG. 2. A person may then wear the backpack 16 with the jacket 14 enclosed in the pouch 36.

In an alternative embodiment, two zippers **38*a* and 38*b* may be used to secure the flap 32 to the back surface 20 of the backpack 16. The zippers begin at the lower end 28 of the back surface 20 outside of the point where the shoulder straps attach to the backpack. The zippers then zip upward and meet at the upper end of the back surface 20 of the backpack 16. An embodiment of the invention with two zippers is shown in FIG. 5**.

Figure 4:
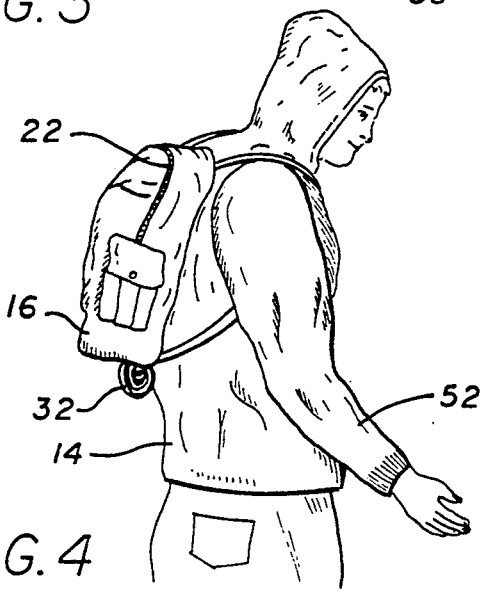
FIG. 4 is a perspective view of a person using both the backpack and the jacket of this invention.

FIG. 4 shows a person wearing the combination 12 backpack and jacket in its second mode of use. When a person desires to wear the jacket 14, the flap 32 is unzipped from the back surface 20 of the backpack 16 and the jacket 14 is removed. The flap 32 is then rolled up, and inserted into temporary securing means on the backpack 16. In the preferred embodiment, as best shown in FIGS. 2 and 3, the securing means is comprised of two straps 50. The straps 50 are attached to the lower end 28 of the back surface 20 of the backpack 16. The straps 50 form loops in which the rolled flap 32 is inserted.

Figure 5:
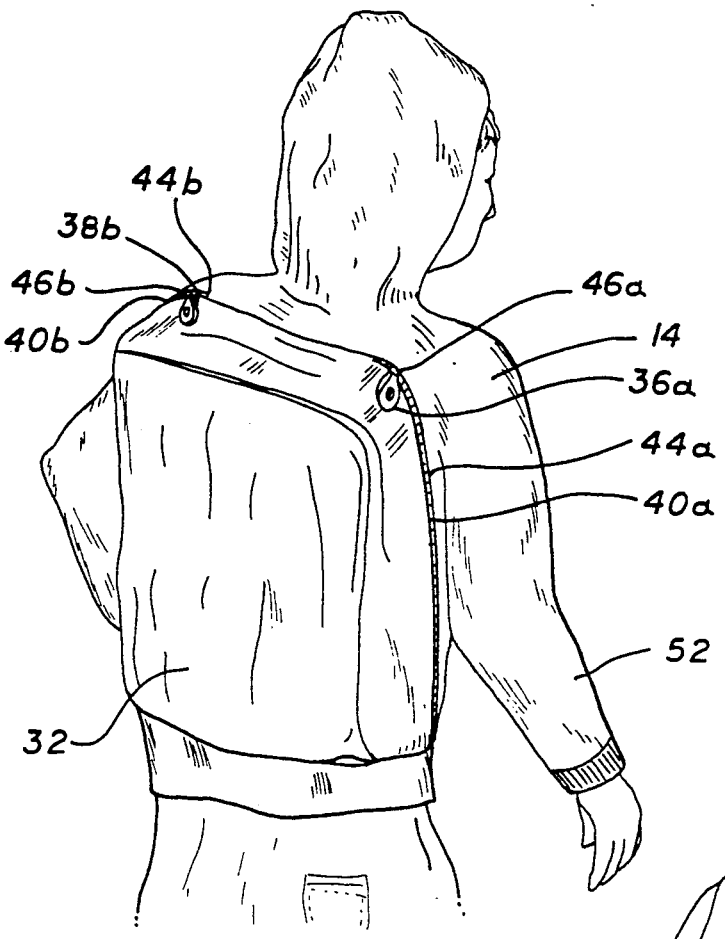
FIG. 5 is a perspective view of the jacket of the present invention with the backpack enclosed against the jacket.

FIG. 5 shows the combination backpack and jacket 12 in a third mode of use. In the method of use shown in FIG. 5, the backpack 16 and shoulder straps 24 are enclosed between the flap 32 and the jacket 14. When a person desires to wear the jacket 14 without the shoulder straps 24 supporting the backpack 16, the flap 32 is pulled up and around the front surface 18 and the side surface 22 of the backpack 16. The combination backpack and jacket 12 therefore also includes means for temporarily securing the flap 32 around the front surface 18 and the side surface 22 to the jacket 14. In the embodiment shown, two zippers, **38*a* and 38*b* are used to secure the flap 32 in place. Each of the zippers 38*a* and 38*b* has a first row of teeth 40*a* and 40*b* sewn to a portion of the periphery of the flap 32. It should be noted that in the preferred embodiment, the first row of teeth 40*a* and 40*b* are the same first row of teeth 40 used to secure the flap 32 to the backpack back surface 20 in FIGS. 2 and 2. The zippers 38*a* and 38*b* further include a corresponding mating row of teeth teeth 44*a* and 44*b* sewn to a matching configuration 46*a* and 46*b* on the jacket 14. Therefore, when the flap 32 and shoulder straps 24 are to be secured against the jacket 14, the flap 32 is pulled up and around the backpack front and side surfaces 18 and 22, and the shoulder straps 24 are tucked between the backpack back surface 20 and the jacket 14. The first row of teeth 40*a* and 40*b* of the zippers 38, located on the flap 32, will then be in a position to zip into the second row of teeth 44*a* and 44*b* of the zippers 28, located on the jacket 14. After the zippers 38 are zipped closed, the backpack 16 and shoulder straps 24 are concealed, as shown in FIG. 5. Although the location of the shoulder straps 24 may prevent the flap 32 from entirely enclosing the backpack 16, the backpack 16 is substantially enclosed against the jacket 14. This mode of use is beneficial in several situations. For one, this mode of use allows the wearer to wear the jacket 14 with an empty backpack 16, and not be burdened by the shoulder straps 24 of the backpack 16. Secondly, this mode of use prevents the backpack 16 from the elements, such as rain, snow, or mud, if so desired. Thirdly, this mode of use prevents the backpack 16** from catching or snagging on tree limbs and other obstacles when a person is hiking.

Figure 6:
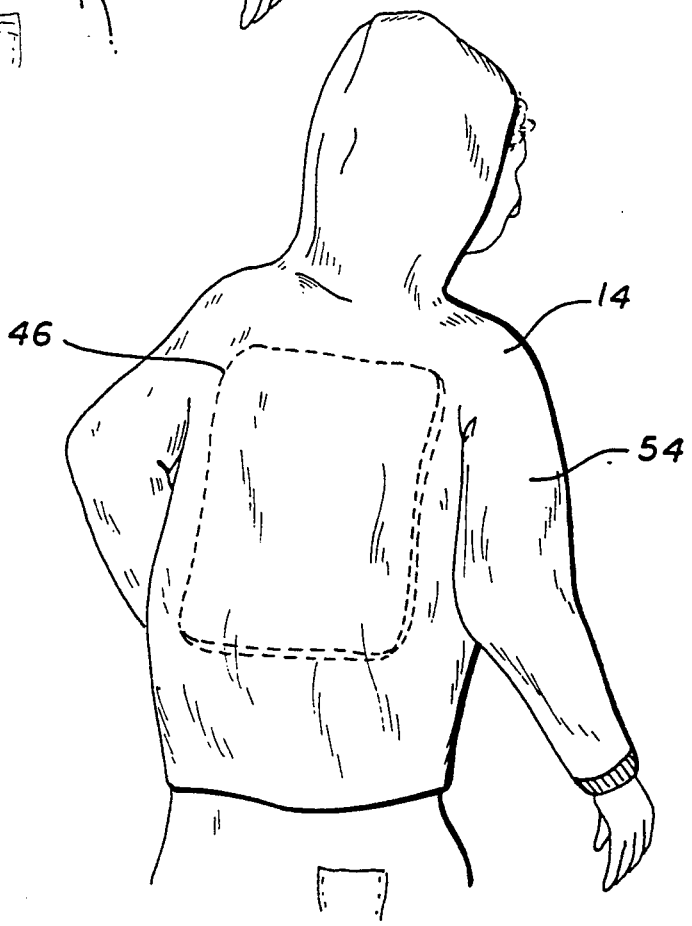
FIG. 6 is a perspective view of a person wearing the present invention with the backpack enclosed against the reversible jacket, and the reversible jacket turned inside out.

FIG. 6 shows a person wearing the combination backpack and jacket 12 in its fourth mode of use. In this embodiment, the jacket 14 is reversible, and thus has an obverse surface 52 (shown in FIG. 5) and a reverse surface 54. Once the backpack 16 is in an enclosed position, as described and shown in FIG. 5, the entire jacket 14 is turned inside out so that the reverse surface 54 faces outward (as shown in FIG. 5). The backpack will be held in a secured position against the obverse surface 52 of the jacket 14, allowing the person to comfortably wear the jacket 14 inside out.

Preferably, the jacket 14 is constructed out of a lightweight, nylon material to enable it to be compactly stored in the pouch 36. The backpack 16, flap 32, and straps 24 and 46 are preferably constructed of a durable, waterproof nylon material.

Having thus described exemplary embodiments of the present invention, it should be noted by those skilled in the art that the within disclosures are exemplary only and that various other alternatives, adaptations and modifications may be made within the scope of the invention. Thus by way of example, but not of limitation, instead of the zipper 38, some other type of temporary connecting device, such as VELCRO (TM), can be used to secure the flap 32 in its various positions. Also other types of devices may be used to secure the flap 32 to the lower end 28 of the back surface 20 of the backpack 16 when not in use. For example, the flap 32 may be folded into a separate pouch at the lower end 28. The reversible jacket 14 may also be constructed with two different types of fabric on the obverse surface 52 and the reverse surface 54. Accordingly, it is to be understood that the present invention is not limited to the precise construction as shown in the drawings and described hereinabove.

I claim:

1. A combination backpack and reversible jacket comprising:

a reversible jacket, said reversible jacket having an obverse surface and a reverse surface;

a backpack, said backpack having a front surface, a back surface, and a side surface, wherein said back surface has a lower end and an upper end, and wherein a portion of said obverse surface of said reversible jacket is permanently attached to said lower end;

two shoulder straps, each of said shoulder straps being attached at said upper end and at said lower end of said back surface;

a flap attached along a partial length of one edge of said flap to a central area of said lower end of said back surface of said backpack;

first means for temporarily securing said flap around said back surface of said backpack, thereby forming a pouch on said back surface in which said reversible jacket may be stored;

second means for temporarily securing said flap to said jacket obverse surface, wherein said front surface and said side surface of said backpack are enclosed between said flap and said jacket obverse surface, thereby concealing the backpack when said reversible jacket is being worn with said obverse surface out, and also maintaining said backpack in a stable position against said obverse surface of said jacket when said jacket is worn with said reverse surface facing out; and third means for temporarily securing said flap in a compact position to said lower end of said back surface.

2. A combination backpack and reversible jacket in accordance with claim 1 wherein said first securing means is comprised of at least one zipper, each of said zippers having a first row of teeth located along a substantial portion of the periphery of said flap, and a mating row of teeth located along a substantial portion of the periphery of said back surface of said backpack.

3. A combination backpack and reversible jacket in accordance with claim 1 wherein said second securing means is comprised of at least one zipper, each of said zippers having a first row of teeth located along a substantial portion of the periphery of said flap, and a mating row of teeth located along a substantial portion of the periphery of said back surface of said backpack.

4. A combination backpack and reversible jacket in accordance with claim 1 wherein said third securing means comprises a plurality of straps, said straps being secured in a looplike fashion to said lower end of said back surface of said backpack.

5. A combination backpack and reversible jacket in accordance with claim 1 wherein said reversible jacket is constructed of a nylon material.

6. A combination backpack and reversible jacket in accordance with claim 1 wherein said backpack and said flap are constructed of a nylon material.

7. A combination backpack and jacket comprising:

a jacket;

a backpack, said backpack having a front surface, a back surface, and a side surface, wherein said back surface has an upper end and a lower end, and further wherein a portion of said jacket is attached to said lower end;

two shoulder straps, each of said shoulder straps being attached at said upper end and said lower end of said back surface;

a flap, said flap having a portion of one edge attached at said lower end of said back surface;

first means for temporarily securing said flap around said back surface, thereby forming a pouch on said back surface in which said jacket may be stored;

second means for temporarily securing said flap to said jacket wherein said front surface and said side surface of said backpack are enclosed between said flap and said jacket, and further wherein said backpack is concealed when said jacket is being worn; and third means for securing said flap in a compact position to said lower end of said back surface.

8. A combination backpack and jacket in accordance with claim 7 wherein said jacket is reversible, thereby having an obverse surface and a reverse surface.

9. A combination backpack and jacket in accordance with claim 8 further comprising fourth means for temporarily securing said backpack in a position against said obverse surface of said jacket when said jacket is turned so as to have said reverse surface facing out.

10. A combination backpack and jacket in accordance with claim 7 wherein said backpack and said jacket are constructed of a nylon material.

11. A combination backpack and jacket comprising:

a jacket;

a backpack, said backpack having a front surface, a back surface, and a side surface, wherein said back surface has an upper and end and a lower end, and further wherein a portion of said jacket is attached to said lower end;

two shoulder straps, each of said shoulder straps being attached to said upper end and said lower end of said back surface;

means for defining a pouch in which to store said jacket when said jacket is not in use; and means for temporarily enclosing said backpack against said jacket when said jacket is being worn.

12. A combination backpack and jacket in accordance with claim 11 wherein said jacket is reversible, thereby having an obverse surface and a reverse surface.

13. A combination backpack and jacket in accordance with claim 11 wherein said pouch defining means further comprises:

a flap, said flap having a portion of one edge attached to said lower end of said back surface of said backpack; and a zipper, said zipper having a first row of teeth attached to a substantial portion of the periphery of said flap and a mating row of teeth attached to a substantial portion of the periphery of said back surface of said backpack, wherein a pouch is formed on said back surface when said flap is extended over said back surface and said zipper is closed.

14. A combination backpack and jacket in accordance with claim 11 wherein said enclosing means further comprises:

a flap, said flap having a portion of one edge attached to said lower end of said back surface; and a zipper, said zipper having a first row of teeth attached to a substantial portion of the perimeter of said flap and a mating row of teeth attached to the back surface of said jacket, wherein said backpack is substantially enclosed when said flap is extended around said front surface and side surface and said zipper is closed.

15. A combination backpack and jacket in accordance with claim 11 wherein said backpack and said jacket are constructed of a nylon material.

* * * * *